US005110089A

United States Patent [19]

Slay

[11] Patent Number: 5,110,089

[45] Date of Patent: May 5, 1992

[54] EXTENDIBLE JACK STAND

[75] Inventor: Clyde E. Slay, Santa Ana, Calif.

[73] Assignee: Safe-T-Jack, Inc., Huntington Beach, Calif.

[21] Appl. No.: 503,297

[22] Filed: Apr. 2, 1990

[51] Int. Cl.[5] ..... B66F 5/04

[52] U.S. Cl. ..... 254/8 B; 254/102; 254/108

[58] Field of Search ..... 354/8 R, 8 B, 8 C, 89 R, 354/98, 102, 108, 124

[56] References Cited

U.S. PATENT DOCUMENTS

| | | | |
|---|---|---|---|
| 1,088,953 | 3/1914 | Willet | 254/8 B |
| 1,333,645 | 3/1920 | Walker | 254/8 B |
| 4,462,569 | 7/1984 | Arzouman | 254/89 R |
| 4,589,630 | 5/1986 | Arzouman | 254/8 B |
| 4,641,813 | 2/1987 | Arzouman | 254/8 B |
| 4,960,264 | 10/1990 | Arzouman et al. | 254/89 R |

*Primary Examiner*—J. J. Hartman
*Attorney, Agent, or Firm*—Gene W. Arant

[57] ABSTRACT

An extendible jacking apparatus including first, second and third normally vertical frames arranged in telescoping relationship, and containing a locking mechanism for automatically locking the first and second frames together while the third frame is being raised, locking the second and third frames together when the third frame is fully raised, and unlocking the first and second frames to allow extension of the second frame. Conversely, the locking mechanism is automatically reversible as the jack is lowered, unlocking the second and third frames and relocking the first and second frames upon the second frame being fully retracted into the first, allowing the third frame to allow be fully retracted into the first and second frames.

11 Claims, 5 Drawing Sheets

S
P
D
C
L
55
B
57
50
40
34
32
30
36
33
A
10
14
12
J
J'
16
18
2
3
4
5
59
58
57a
L1
53
52

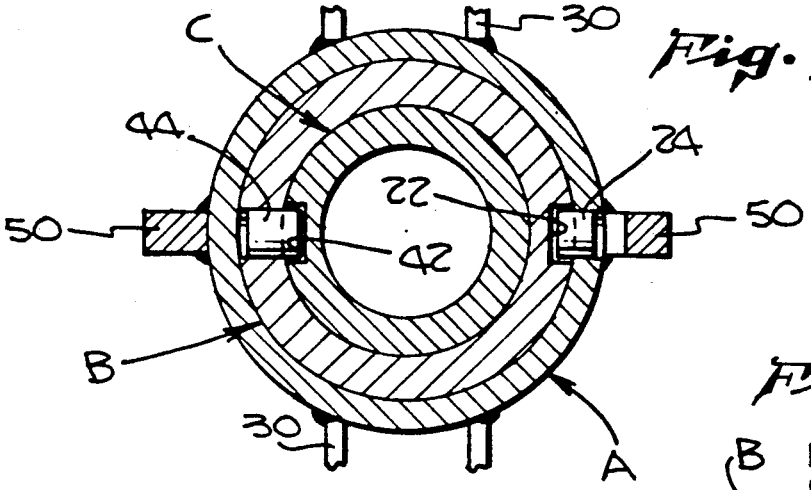
Fig. 7.
Fig. 12.
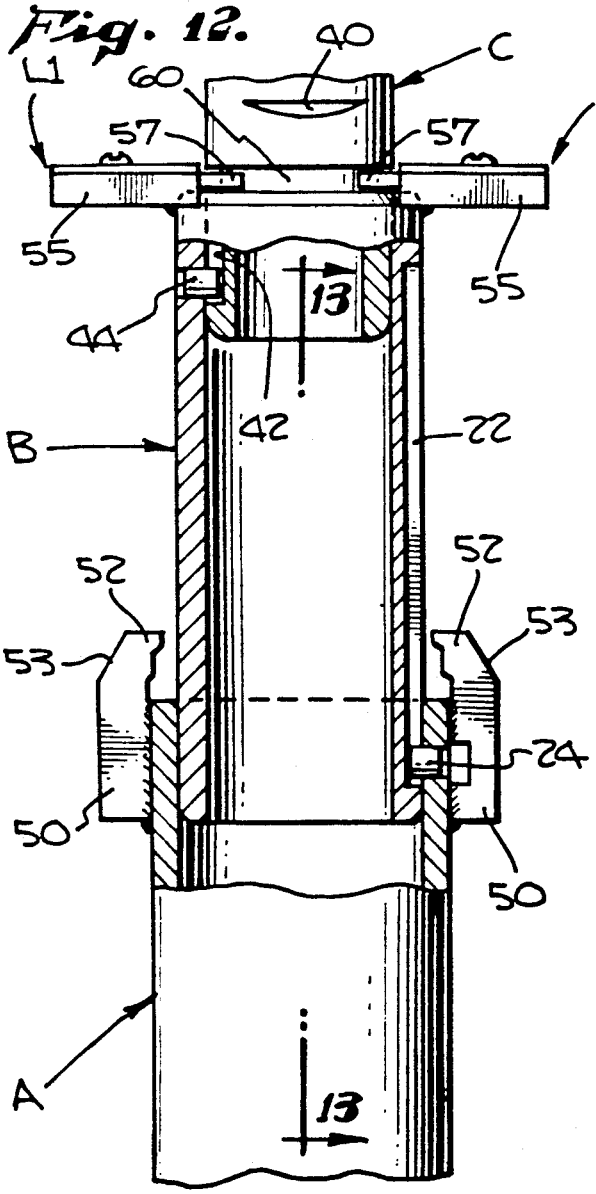
Fig. 13.
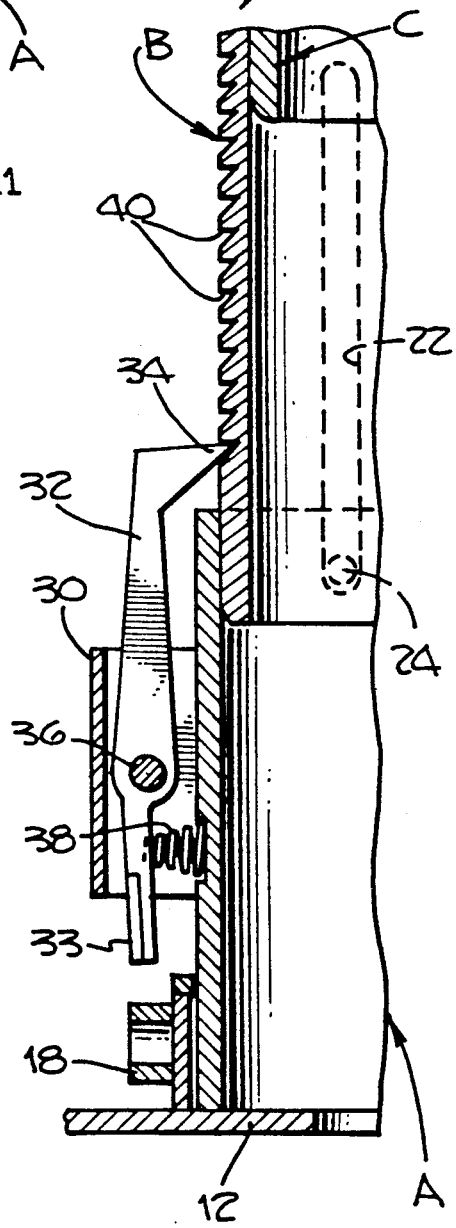

EXTENDIBLE JACK STAND

RELATED APPLICATION

A related patent application assigned to the same assignee as the present application is "ALIGNMENT AND RELEASE MECHANISM FOR A TWO-PART JACK SYSTEM", Ser. No. 350,111 filed May 9, 1989 in which the present applicant is a co-inventor.

PRIOR ART

A jacking system that includes a mechanical jack stand which is remotely controlled by a power unit selectively attached to the mechanical stand is shown in U.S. Pat. No. 4,462,569. An EXTENDIBLE JACK STAND ADAPTED FOR REMOTE CONTROL is disclosed and claimed in U.S. Pat. No. 4,553,727.

BACKGROUND OF THE INVENTION

Extendible or adjustable stands are used in a wide variety of situations, such as a music stand whose height is adjustable, a cane of adjustable length, and so on.

The present invention has arisen in connection with a jacking system that includes a mechanical jack stand which is remotely controlled through a power unit that may be selectively attached to or detached from the mechanical jack stand.

An adjustable stand may include only two frames which are initially arranged in overlapping relationship to each other, and which are then extended longitudinally to increase the overall length of the apparatus while reducing the overlapping portions of the two frames. Extending or retracting one of two frames is not a difficult matter, as is amply demonstrated in the prior art. However, when two or more frames are to be extended, control of the action presents additional problems. This is particularly true in a jacking system where the extension or retraction of a mechanical stand is controlled remotely.

SUMMARY OF THE INVENTION

According to the present invention an extendible stand includes first, second, and third elongated frames which are normally arranged in telescoping relationship. In extending the stand the second frame is held in place within the first frame while the third frame is extended, and then the second frame is extended. In retracting the stand the second frame is retracted first, and then the third frame is retracted into the second frame. A locking means provided in accordance with the invention automatically locks together the frames that are not then being extended or retracted.

Thus, an object of the present invention is to provide an improved form of extendible stand which is amenable to being extended or retracted through automatic control means, rather than manually.

A more specific object of the present invention is to provide an improved mechanical jack stand which may be utilized in the type of jack system that also includes a separate power unit which is selectively attachable to the mechanical jack stand for remotely controlling its operation.

DRAWING SUMMARY

FIG. 7 is a horizontal cross-sectional view taken on the line 7—7 of FIG. 6;

FIG. 12 is a cross-sectional elevation view of the second vertical frame of the jack stand when both the second and third vertical frames are in fully raised positions, showing the position then occupied by the locking means; and FIG. 13 is a vertical cross-sectional view taken on the line 13—13 of FIG. 12, showing the position of the ratchet mechanism.

DETAILED DESCRIPTION (FIGS. 1 through 13)

Overall Arrangement

Figures 1, 2, 3:
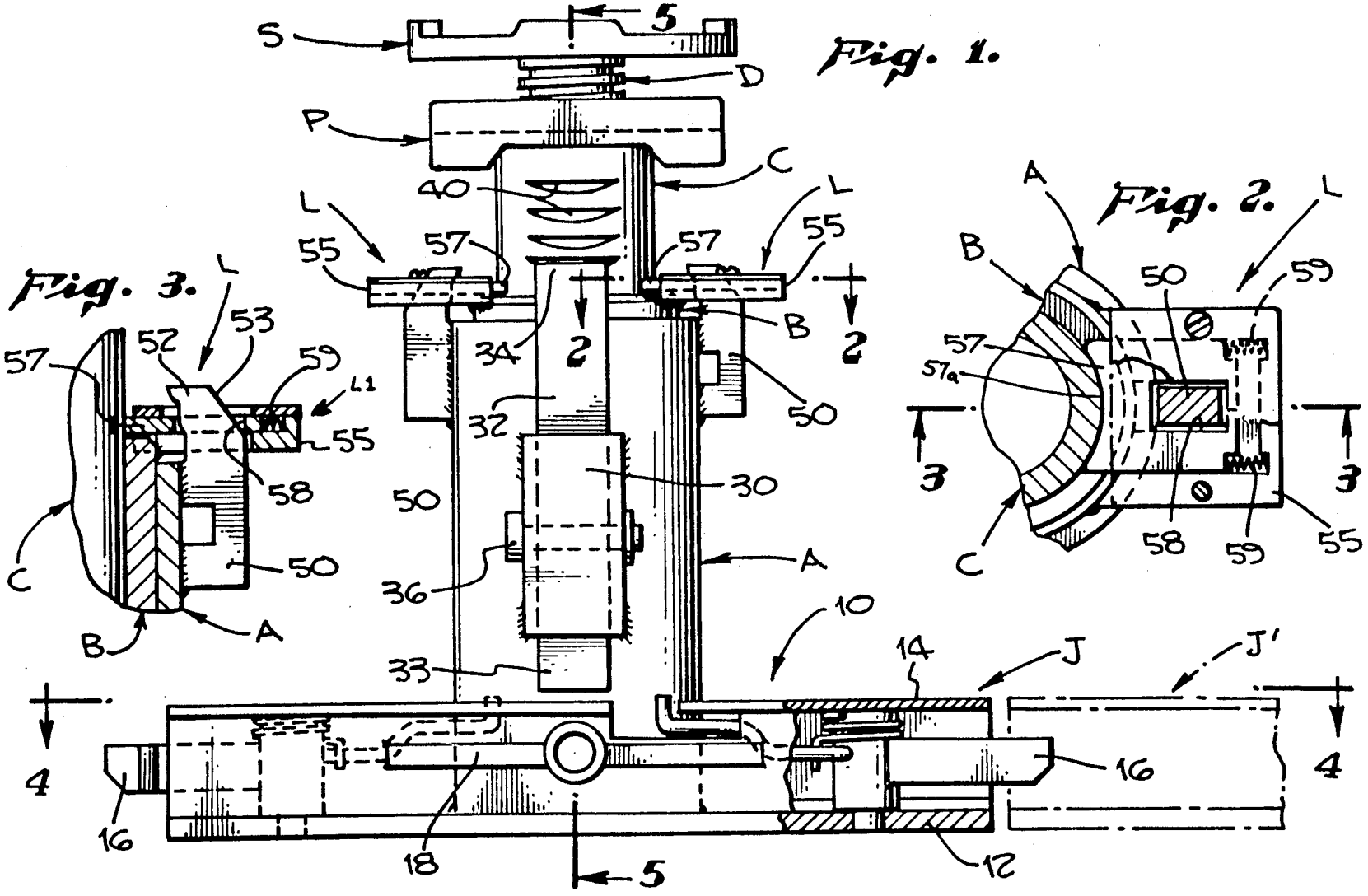
FIG. 1 is a side elevation view of an extendible jack stand in accordance with the presently preferred form of the invention, having four vertical frames, and with its third frame in partially extended position.
FIG. 2 is a fragmentary cross-sectional view taken on the line 2—2 of FIG. 1, showing in accordance with the invention an automatic locking means for locking the frames in position.
FIG. 3 is a fragmentary cross-sectional view of the locking means taken on the line 3—3 of FIG. 2.
Figure 4:
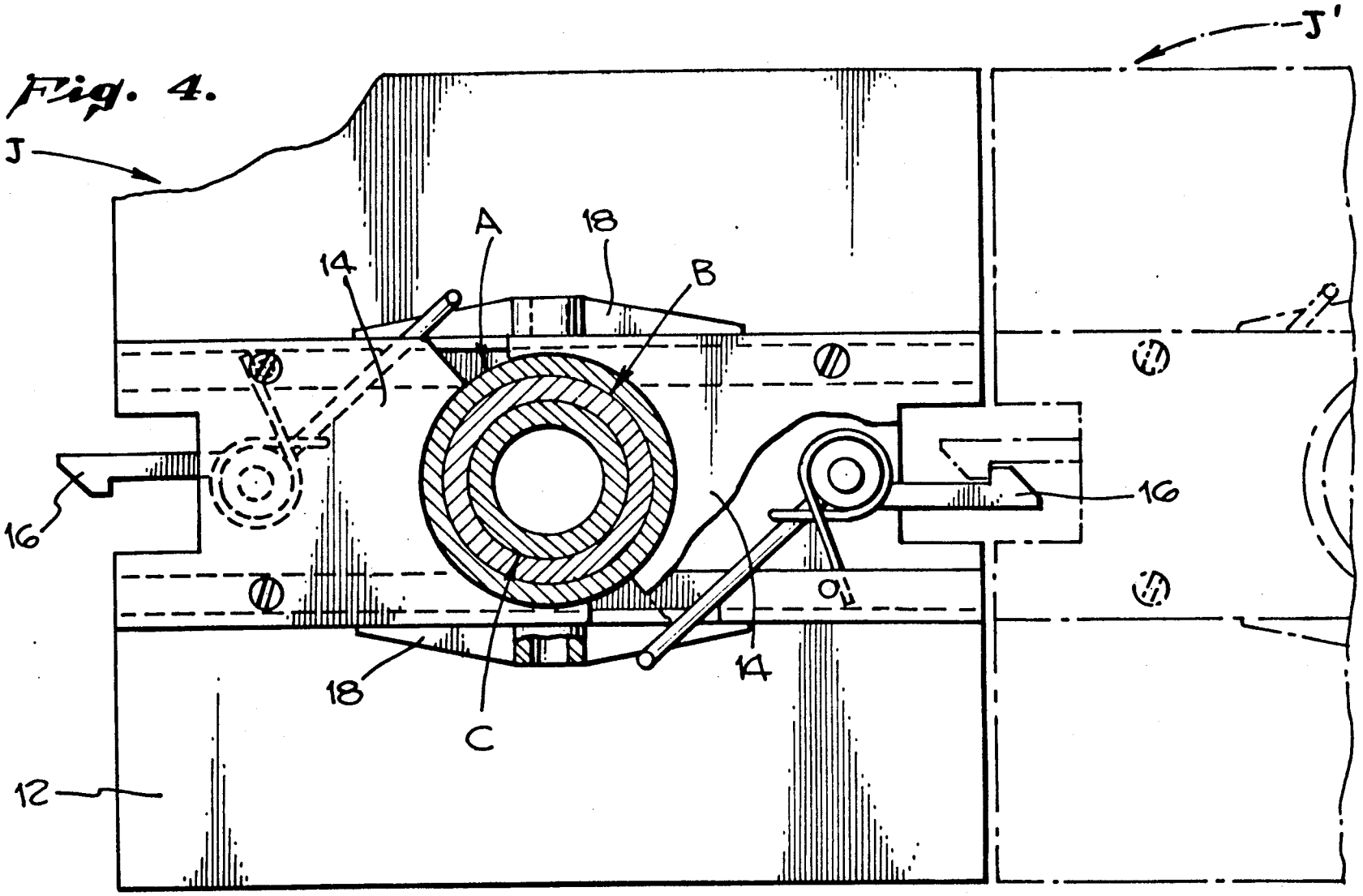
FIG. 4 is a plan view taken on line 4—4 of FIG. 1, showing the base of the jack stand and also showing the first, second and third vertical frames in cross-section.
Figure 6:
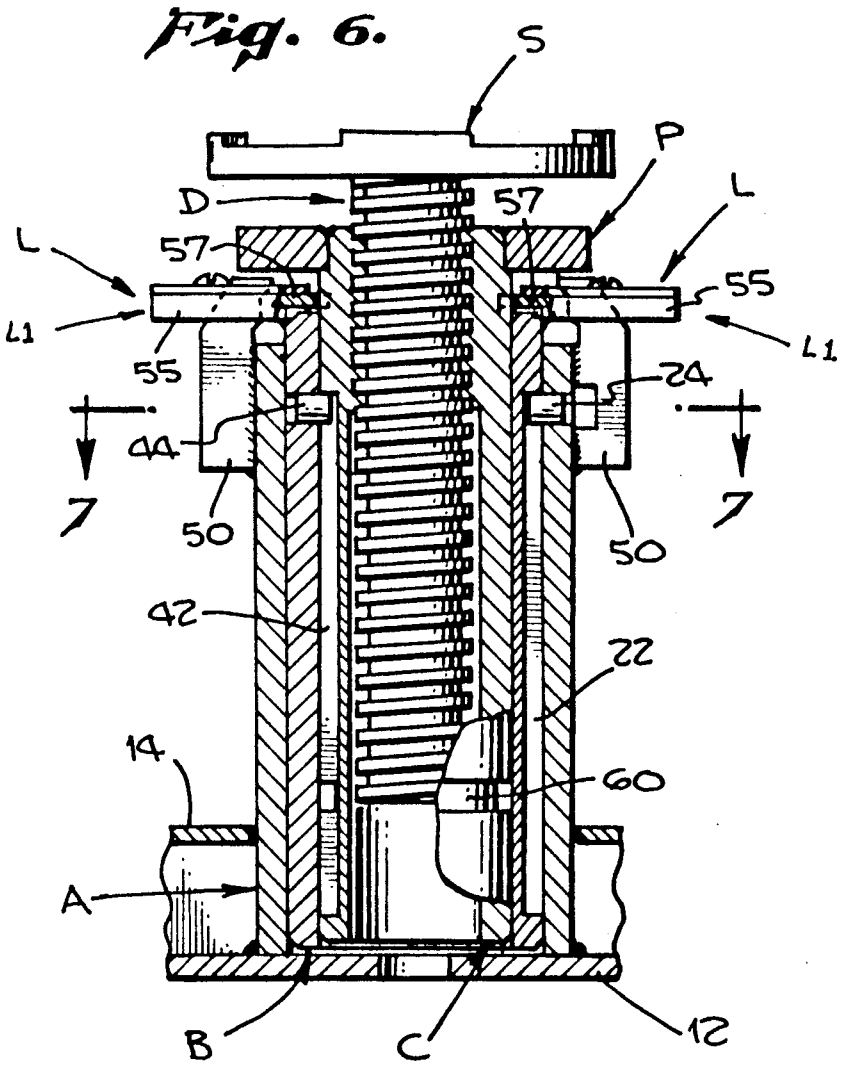
FIG. 6 is a cross-sectional elevation view taken on the line 6—6 of FIG. 5, and showing the locking means.

Referring now to the drawings, an extendible jack stand J includes a horizontal base assembly 10, a first vertical frame A which is fixedly attached to the base assembly and which is hollow, a second vertical frame B which is telescopically received within the frame A, a third vertical frame C which is telescopically received within the frame B, and a fourth vertical frame D which is screw-threaded into the upper end of frame C. A locking means L is fastened in part to frame A and in part to frame B, as will be explained. Stand J also includes ratchet mechanisms for establishing a precise extension position of the jack stand assembly; a lifting plate P on the upper end of frame C; and a load-bearing plate on the upper end of frame D.

The purposes of the jack stand and its mode of use will be best understood by reference to the issued U.S. Pat. No. 4,462,569, issued U.S. Pat. No. 4,553,727, and the above-identified copending application. In particular, the structure and operation of base assembly 10 are fully illustrated and described in the copending application. The ratchet mechanisms and their mode of operation are essentially as disclosed in the two previous patents and the pending patent application.

The use of the fourth frame D is optional. It may, if desired, be removed, and the top plate of frame C may then be used as the load-bearing plate.

Before describing in detail the structure and operation of the locking means L it will be helpful to first provide a general description.

GENERAL DESCRIPTION OF STRUCTURE AND OPERATION

According to the invention, an extendible stand includes first, second, and third vertical frames A, B and C arranged in telescoping relationship, the second frame B being normally retracted within the first frame A, and the third frame C being normally retracted within the second frame B. Locking means L includes an upwardly extending finger 50 fixedly secured to an outer surface of the upper end of the first frame A, a guide member 55 secured to the upper end of the second frame B and extending horizontally outwardly therefrom, a latch member 57 horizontally slidable in the guide member 55, and spring means 59 urging the latch member 57 inwardly over the upper end of the second frame B and, ultimately, into engagement with the circumferential groove 60 in the outer surface, and near the lower end, of the third frame C.

In its lowered position, the first and second frames A and B are essentially locked together, while the third frame C is free to move relative to the second frame B until C is fully raised relative to second frame B, whereupon the second and third frames B and C become locked together. Until the second and third frames B and C are locked together the second frame B is allowed a slight amount of upward movement relative to the first frame A (which upward movement allows the latch member 57 to slide inward as needed to lock the third frame C as described below).

In particular, as an upward force is applied to the lifting plate P, the third frame C is raised upward. Internal friction between third frame C and second frame B, as well as an upward force to frame B caused by the action of spring 59 and latch member 57 against the sloping camming surface 53 of the finger 50, cause the second frame B to rise upward. However, the latch member 57 and the curved over member 52 of finger 50 act cooperatively to restrain the second frame B from being extended relative to the first frame A, and beyond the barrier formed by curved over member 52, until third frame C becomes fully extended relative to second frame B, and these two frames become locked together.

When the third frame C becomes fully extended relative to the second frame B, the spring means 59 urges the latch member 57 into the groove 60 of the third frame C, while the central opening 58 of the latch member 57 moves inward and opens relative to bent end 52, thereby releasing the restraining action so as to permit the second frame B to be extended relative to the first frame A.

In retracting, after the second frame B has been retracted into the first frame A, the latch member 57 and the finger 50 cooperatively respond to a retracting movement of the second frame for withdrawing the latch member 57 from the groove 60 in the third frame C, thereby permitting the third frame C to be retracted into the second frame B.

THE MECHANISMS

The base assembly 10 includes a bottom plate 12, an upper plate 14 supported on side walls, a pair of spring-loaded latch fingers 16 occupying respective ends of the space between plates 12 and 14, and a pair of ramps 18 secured to respective side walls. The latch fingers 16 function is to secure two or more jack stands J, J', etc., in a series relationship, as disclosed in detail in the copending application Ser. No. 800,311. The purpose of the ramps 18 is to provide for convenient alignment of a hydraulic power unit to the jack stand, as also disclosed in detail in the copending application Ser. No. 350,111.

Figure 5:
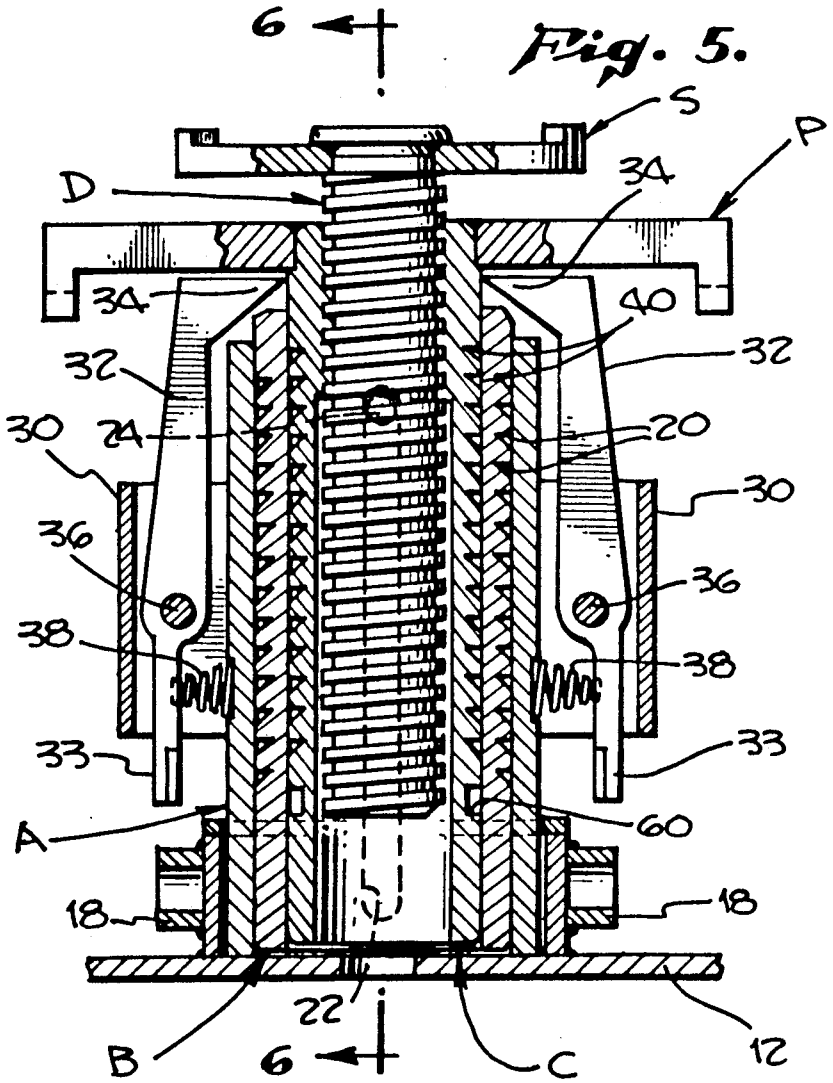
FIG. 5 is an elevation view taken on the line 5—5 of FIG. 1, showing three of the vertical frames in cross-section.

First frame A is a cylindrical steel member whose lower end extends downward through the upper plate 14 of base 10 and is welded to bottom plate 12, as shown in FIG. 1. Various features of frame A are shown in all of FIGS. 1 through 13, inclusive. Frame B, also a cylindrical member, is telescopically received within frame A. Frame B has vertical rows of ratchet teeth 20 formed on two opposite sides of its outer wall surface, as best seen in FIGS. 5 and 13. In order to maintain the rotational orientation of the ratchet teeth 20 relative to base assembly 10 there is a vertical groove 22 formed at one point on the circumference of the outer wall surface of frame B and which extends throughout most of the length of frame B. A short pin 24 secured in an opening in the wall of frame A extends into the groove 22 and thus secures frame B against rotation. See FIGS. 6, 7, and 12.

Frame A has a pair of ratchet arm housings 30 secured to opposite sides of its exterior surface, FIGS. 1, 5, and 13. Within each such housing there is a vertically extending ratchet arm 32 having a tooth or dog 34 formed on its upper end; see FIG. 5. Each ratchet arm is supported near its longitudinal center by a pivot pin 36 which is in turn secured within the corresponding housing. A spring 38 forces the lower end of each ratchet arm outward so that the dog 34 on its upper end will reliably engage the ratchet teeth of frame B or frame C. This general arrangement of ratchet arms is shown in U.S. Pat. No. 4,553,727 referred to above. The lowermost end 33 of each ratchet arm 32 is exposed beneath the corresponding housing where a horizontal force may be applied for releasing the engagement of its dog 34 with a ratchet tooth, all as taught in that patent.

Frame C, likewise a hollow cylindrical member, has vertical rows of ratchet teeth 40 formed on two opposite sides of its outer wall surface, as best seen in FIGS. 1, 5, 8 and 9. In order to maintain the rotational orientation of the ratchet teeth 40 relative to base assembly 10 there is a vertical groove 42 formed at one point on the circumference of the outer wall surface of frame C and which extends throughout most of the length of frame C. A short pin 44 secured in an opening in the wall of frame B extends into the groove 42 and thus secures frame C against rotation. See FIGS. 6, 7, and 9.

Dual locking means L includes a first lock part which is fixedly attached to frame A and a second lock part L1 fixedly attached to the second frame B. The first lock part is a finger 50 which is secured to the outer surface of the first frame A near its upper end. See FIGS. 1–3, 6, 7, and 9–12. Since there are two identical locking means L, the two fingers 50 are on opposite sides of the first frame A. The ratchet teeth 20, 40, and ratchet arms 32 are in one vertical plane, while the lock fingers 50 are in another and mutually perpendicular plane. Each lock finger 50 has an upper end 52 which extends above the upper end surface of frame A and which is bent or curved inwardly, toward the radial center of the hollow frames. In addition, each lock finger 50 has a sloping outer camming surface 53.

A second lock part L1 of each locking means L is a guide member 55, fixedly attached to the outer surface of frame B near its upper end and extending horizontally outwardly. See FIGS. 1-3, 6, and 9-12. Guide member 55 is in the form of a housing having a lower portion that is welded to the outer side wall surface of frame B and an upper portion which extends above the upper end surface of frame B.

A latch member 57 in the form of a flat plate, with curved surface 57*a* intended to fit into circumferential grove 60 of frame C, is slidably supported within each guide member 55. The latch member 57 has a central opening 58 (FIGS. 2, 3, 10 and 11) through which the associated finger 50 may extend. An associated spring 59 urges each latch member 57 radially inward toward the radial center of the frames A, B and C.

The sloping camming surface 53 at the upper end of finger 50 is designed to control the radially inward or radially outward movement of the associated latch member 57, in cooperation with spring 59. This action takes place because frame B carrying the second latch part L1 (consisting of guide member 55 and latch member 57) moves up and down relative to frame A (which carries the finger 50). More particularly, the upper end of the sloped outer camming surface 53 of the lock finger 50 is sufficiently narrow to permit the latch member 57 to slide inward and into the circumferential groove 60 of the third frame C. Conversely, the lower end of the wedge-shaped camming surface 53 is sufficiently broad to cause the latch member 57 to be withdrawn from the groove 60 of the third frame C.

The cooperative action of the lock finger 50 and the latch member 57 is aided also by the spring 59, which applies an inward directed force against the latch member 57 and is sufficiently strong to overcome any friction between the latch member 57 and the bent over upper end 52 of the finger 60 whenever the second frame B is being forced upward relative to the first frame A, and while the two are locked together.

There is another special feature which aids the locking and the unlocking actions. Thus, the third frame C has a circumferential groove 60 formed in its outer surface near its lower end into which the latch member 57 is forced by the spring 59.

Frame C also has a lift plate P on its upper end, to be engaged and lifted by the lift arms of a power unit, as taught in the prior patents listed above.

In addition to the telescoping frames A, B, and C, there is a fourth frame D which screws into a threaded opening in the upper end of frame C. When frame D is used, a load seat S on its upper end is the means for carrying or lifting a load. However, the use of frame D is optional, and when it is omitted the plate P carries the load.

MODES OF OPERATION

FIGS. 1-3 and 6 show the condition of the jack stand when the second frame B remains retracted inside the first frame A and the third frame C has not been fully extended. The latch member 57, under horizontal pressure from the spring 59, extends over the upper end surface of the second frame B and also bears against the vertical outer surface of the third frame C. The radially inward portion of latch member 57, which occupies the space between finger 50 and frame C, is captured by the bent-over upper end 52 of lock finger 50. That is, bent end 52 overhangs the radially inward edge of the opening in the latch member 57 (FIG. 3). Thus, latch member 57, together with the help of finger 50, effectively captures the second frame B so that an upward force applied to plate P causes only the third frame C to extend, and not the second frame B (beyond the distance between the lower end of the camming surface 53 and the bent-over upper end 52 of the finger 50).

When frame C reaches its full extension, however, the latch member 57 is pushed further inward under the force of the spring 59 and then occupies the circumferential groove 60 in the lower end surface of frame C. See FIGS. 5, 6, and 9-12. This action locks the second and third frames B and C together so that further pulling or lifting of the third frame C causes the second frame B to extend upward relative to the first frame A. The second frame B is then able to reach its full extension.

Figure 9:
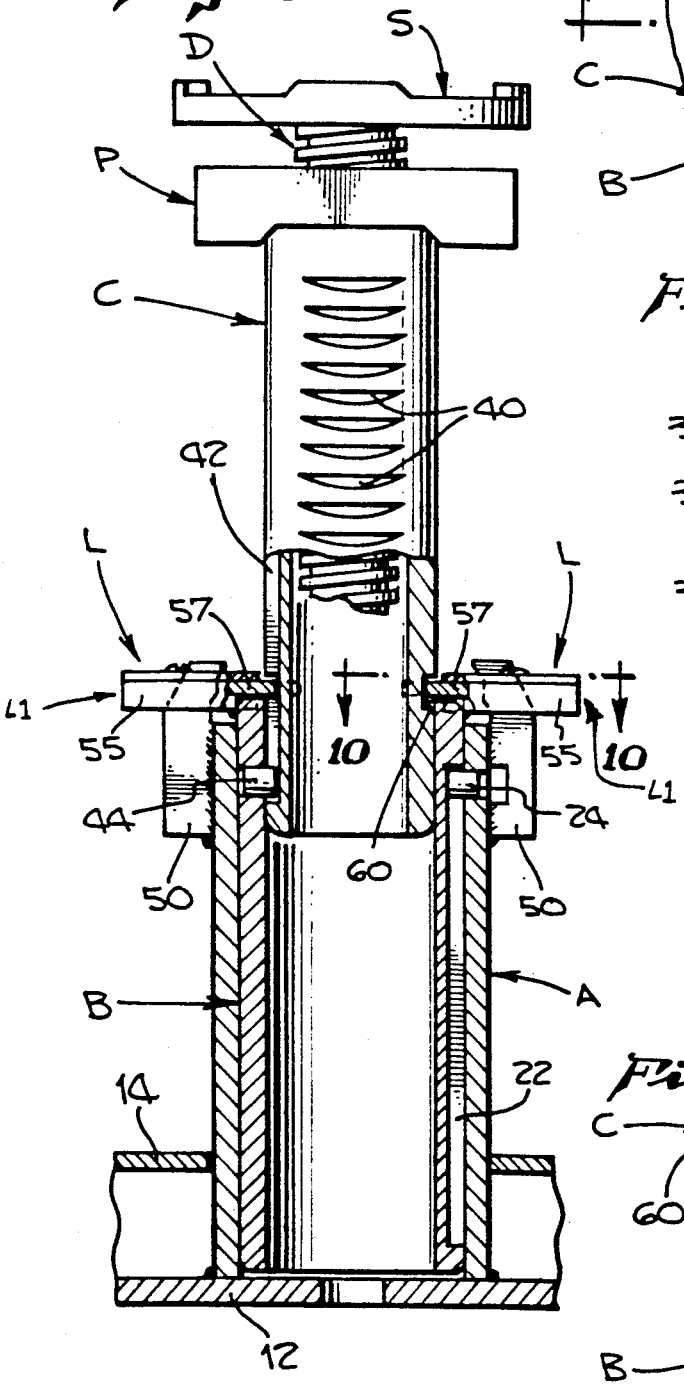
FIG. 9 is an elevation view, partially in cross-section, showing the third vertical frame when fully extended relative to the first and second frames, and the position then assumed by the locking means.
Figure 10:
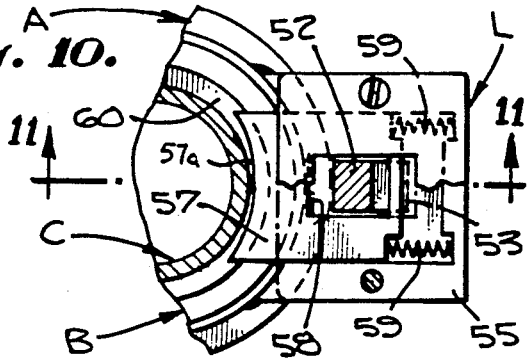
FIG. 10 is a fragmentary horizontal cross-sectional view taken on the line 10—10 of FIG. 9, showing the locking means.
Figure 8:
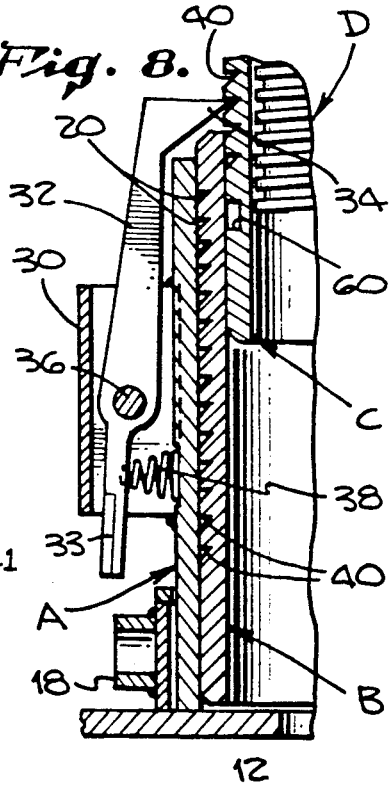
FIG. 8 is a cross-sectional elevation view of one side portion of the jack stand showing the operation of the ratchet mechanism when locking the third vertical frame in partially raised position relative to the second frame.

FIG. 1 shows partial extension of the third frame C, and FIGS. 9 and 12 show its full extension. The latch plate 57 has now been forced into the circumferential groove 60 of the third frame C.

Figure 11:
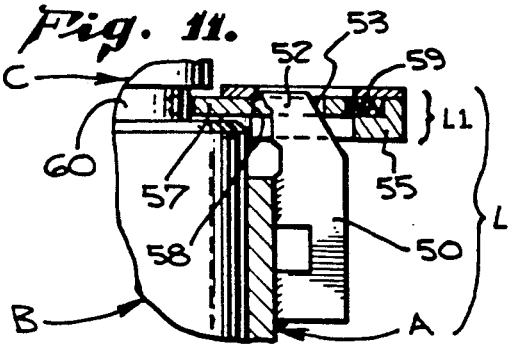
FIG. 11 is a fragmentary vertical cross-sectional view of the locking means taken on line 11—11 of FIG. 10.

When the reverse action takes place, the second frame B must first be retracted into the first frame A because the second and third frames B and C are still locked together. As the second frame B becomes fully retracted within the first frame A, the weight or force that has pushed the locked second and third frames B and C towards the first frame A is then effective for causing the outer camming surface 53 of the lock finger 50 to slidably move the latch plate 57 outward against the force of the spring 59 until it is completely withdrawn from the circumferential groove 60 of the third frame C (FIGS. 3 and 11). Then the third frame C retracts inside the second frame B.

Thus the apparatus of the invention includes a longitudinally extending finger 50 carried by the first frame A; a latch member 57 carried by the second frame B, and transversely slidable either inwardly or outwardly within guide member 55 and across the end of the second frame B, the latch member having a central opening 58 and the finger 50 having an inwardly curved end 52 which normally extends through that opening for controlling the position of the latch member 57; a spring means 59 urging the latch member 57 inwardly, the latch member 57 normally occupying an outer locked position in which it engages the surface of the third frame C, with the curved finger end 52 preventing longitudinal movement of the latch member 57 and thereby locking the first and second frames A and B together; a recess or groove 60 in the surface of the third frame C, which is engageable by the latch member 57 in an inner locked position so that the latch member 57 then locks the second and third frames B and C against relative longitudinal movement; and the outer sloped surface 53 of the lock finger 50 acting to cam the latch member 57 outwardly whenever the second frame B is retracted relative to the first frame A.

Thus the control of the locking and unlocking actions is achieved by a first latch part (finger 50, 52, 53) carried by the first frame A; a second latch part L1 carried by second frame B consisting of a guide member 55 and a latch member 57 slidably supported therein for inward or outward movement; the end 52 of the finger 50 being curved inwardly; a central opening 58 in the latch member 57 which receives the finger end 52, as well as the outer camming surface 53 of the finger 50; the finger 50 carried by the first frame A normally capturing the latch member 57 carried by the second frame B by means of the bent over surface 52, so that relative longitudinal movement between the two is restricted; a third frame C having a recess 60 which permits the latch member 57 to slide radially inward to a position where it locks the third frame C to the second frame B; and this latter action also serving to move the latch plate 57 out from under the captivity of bent-over end 52 of the finger 50, so that the second frame B can then extend relative to the first frame A.

The invention has been disclosed in considerable detail in order to fulfill the requirements of the patent laws. The scope of the invention, however, is to be determined only with reference to the appended claims.

What I claim is:

1. In an extendible stand, the combination comprising:

first, second, and third normally vertical frames arranged in telescoping relationship; and locking means consisting of a slidable latch attached to said second frame, said latch interacting with a fixed member of said first frame for locking said second frame in fixed relation to said first frame while said third frame is being extended relative to said first and second frames, and said latch then interacting with said third frame for thereafter locking said third frame in fully extended relation to said second frame while said second frame is being extended relative to said first frame;

said locking means being automatically operable through interaction with said fixed member of said first frame for unlocking said third frame relative to said second frame when said second frame is retracted to its original position relative to said first frame.

2. An extendible stand as in claim 1 wherein said locking means inlcudes an upwardly extending finger fixedly secured to the outer surface of the upper end of said first frame, a guide member secured to the upper end of said second frame and extending horizontally outward therefrom, a latch member horizontally slidable within said guide member, and spring means for urging said latch member inwardly over the upper end of said second frame and against the outer surface of said third frame;

said third frame has a horizontal groove in its outer surface near the lower end thereof; and when all three of said frames are in telescoped relation, said latch member and said finger cooperatively act to restrain said second frame from being extended relative to said first frame; and when said third frame becomes fully extended relative to said second frame, said spring means urges said latch member into said groove of said third frame and thereby releases said restraining action so as to permit said second frame to become extended relative to said first frame.

3. The apparatus of claim 2 wherein, when said second frame is subsequently lowered to its original position relative to said first frame, said locking means is automatically operable for unlocking said third frame relative to said second frame.

4. Apparatus as in claim 1 which includes: a longitudinally extending finger carried by said first frame; a latch member carried by said second frame and transversely slidable inwardly to lock said second and third frames together, or outwardly across the end of said second frame to unlock said second and third frames, said latch member having a central opening and said finger having an inwardly sloping upper, outer end which extends through said opening whenever said second frame is retracted relative to said first frame for controlling the position of said latch member; spring means urging said latch member inwardly, said latch member normally occupying an outer locked position in which it engages the surface of said third frame and an inwardly curved upper, inner end of said finger prevents longitudinal movement of said latch member and thereby locks said first and second frames together; a recess in the surface of said third frame which is engageable by said latch member in an inner locked position so that said latch member then locks said second and third frames against relative longitudinal movement; and said sloping upper, outer surface of said finger acting to cam said latch member outwardly whenever said second frame is being retracted into said first frame.

5. An extendible stand comprising:

first, second, and third vertical frames arranged in overlapping but extensible relationship;

base means fixedly supporting said first frame;

locking means for successively locking said second frame in fixed relation to said first frame, and then locking said third frame in fully extended relation to said second frame; and said locking means being operable when an upward lifting force is applied to said third frame for restraining said second frame in fixed relation to said first frame, then being responsive to the arrival of said third frame at a position of maximum extension relative to said second frame, thus locking said third frame in relation to said second frame so that continued application of upward lifting force to said third frame lifts both of said second and third frames relative to said first frame; and thereafter when said third frame is permitted to drop down, said lociking means being responsive to the arrival of said second frame at its original position for unlocking said third frame relative to said second frame so that all three of said frames then resume their original overlapping relationship.

6. An extendible stand as in claim 5 wherein said first frame is hollow and circumdisposed about said second frame, and said second frame is hollow and circumdisposed about said third frame;

said locking means includes an upwardly extending finger fixedly secured to an outer surface of the upper end of said first frame, a guide member secured to the upper end of said second frame and extending horizontally outward therefrom, a latch member horizontally slidable in said guide member, and spring means urging said latch member inwardly over the upper end of said second frame;

said third frame has a horizontal groove in its outer surface near the lower end thereof;

when all three of said frames are in telescoped relation, said latch member and said finger cooperatively act to restrain said second frame from being extended relative to said first frame; and when said third frame becomes fully extended relative to said second frame, said spring means urges said latch member into said groove of said third frame and thereby releases said restraining action so as to permit said second frame to become extended relative to said first frame.

7. The apparatus of claim 6 wherein when both of said second and third frames are in fully extended positions and said second frame is then retracted into the interior of said first frame, said finger interengages with said latch member for withdrawing said latch member from said groove in said third frame, thereby permitting said third frame to be withdrawn into said second frame.

8. An extendible stand comprising:

first, second, and third normally vertical frames arranged in telescoping relationship, said second frame being normally retracted within said first frame and said third frame being normally retracted within said second frame;

locking means including a first part fixedly secured to the upper end of said first frame, a second part fixedly secured to the upper end of said second frame, and a latch member movably supported upon said second part;

said third frame having a recess in its outer surface near the lower end thereof;

when all three of said frames are in telescoped relation. said latch member and said first lock part cooperatively acting to restrain said second frame from being extended relative to said first frame;

when said third frame becomes fully extended relative to said second frame, said latch member being movable into said recess of said third frame and thereby releasing said restraining action so as to permit said second frame to be extended relative to said first frame; and when said second and third frames (being initially locked together) are retracted into said first frame, said latch member and said first lock part cooperatively responding to the arrival of said second frame at its fully retracted position for withdrawing said latch member from said recess of said third frame, thereby permitting said third frame to be retracted into said second frame.

9. Apparatus as in claim 8 wherein said locking means includes spring means associated with said latch member for forcing said latch member into said recess; said first lock part being operable to overcome said spring means when said third frame is retracted into said second frame.

10. An extendible stand comprising:

first, second, and third normally vertical frames arranged in telescoping relationship, said second frame being normally retracted within said first frame and said third frame being normally retracted within said second frame;

locking means including an upwardly extending finger fixedly secured to an outer surface of the upper end of said first frame, a guide member secured to the upper end of said sedond frame and extending horizontally outward therefrom, a latch member horizontally slidable in said guide member, and spring means urging said latching member inwardly over the upper end of said second frame;

said third frame having a horizontal groove in its outer surface near the lower end thereof;

when all three of said frames are in telescoped relation, said latch member and said finger cooperatively acting to restrain said second frame from being extended relative to said first frame;

when said third frame becomes fully extended relative to said second frame, said spring means urging said latch member into said groove of said third frame and thereby releasing said restraining action so as to permit said second frame to be extended relative to said first frame; and when said third frame is retracted into said second frame, said latch member and said finger cooperatively responding to the arrival of said third frame at its fully retracted position for withdrawing said latch member from said groove in said third frame, thereby permitting said second frame to be retracted into said first frame.

11. An extendible jack stand comprising:

(a) a horizontally disposed base;

(b) a first vertical frame fixedly attached to said base and extending upwardly therefrom;

(c) a second vertical frame positioned in telescoping relationship relative to said first frame and having thereon a vertical series of ratchet teeth;

(d) a third vertical frame positioned in telescoping relationship relative to said second frame and having thereon a vertical series of ratchet teeth;

(e) a load-bearing seat carried by the upper end of said thrid frame;

(f) a ratchet arm extending vertically upward along said first frame, being pivotally mounted at its midportion to said first frame and having a dog on its upper end which extends above said first frame;

(g) locking means operable for locking said second frame in fixed relation to said first frame while said third frame is being raised, or for locking said third frame in fully extended relation to said second frame while said second frame is being raised; and (h) said dog of said ratchet arm being oriented inward toward the central axes of the three frames to selectively engage successive ratchet teeth, said ratchet teeth being arranged longitudinally, of whichever frame is then being raised for locking that frame in step-wise fashion.

* * * * *